United States Patent [19]

Hulek

[11] Patent Number: 4,682,646

[45] Date of Patent: Jul. 28, 1987

[54] CONTINUOUS CASTING MOLD FOR SELECTIVELY CASTING STRANDS OF DIFFERENT WIDTHS AND THICKNESSES AND A METHOD FOR OPERATING THE CONTINUOUS CASTING MOLD

[75] Inventor: Anton Hulek, Linz, Austria

[73] Assignee: Voest-Alpine, Linz, Austria

[21] Appl. No.: 770,847

[22] Filed: Aug. 29, 1985

[30] Foreign Application Priority Data

Sep. 10, 1984 [AT] Austria ..... 2892/84

[51] Int. Cl.[4] ..... B22D 11/06

[52] U.S. Cl. ..... 164/481; 164/431

[58] Field of Search ..... 164/427, 428, 429, 430, 164/431, 432, 433, 434, 436, 479, 480, 481, 482, 491

[56] References Cited

U.S. PATENT DOCUMENTS

| | | | |
|---|---|---|---|
| 3,627,025 | 12/1971 | Tromel et al. | 164/479 |
| 4,049,042 | 9/1977 | Maringer | 164/481 |
| 4,367,783 | 1/1983 | Wood et al. | 164/432 |
| 4,562,876 | 1/1986 | Hargassner et al. | 164/436 |

FOREIGN PATENT DOCUMENTS

| | | | |
|---|---|---|---|
| 57-94456 | 6/1982 | Japan | 164/480 |

*Primary Examiner*—Nicholas P. Godici
*Assistant Examiner*—Richard K. Seidel
*Attorney, Agent, or Firm*—Handal & Morofsky

[57] ABSTRACT

A continuous casting mold for selectively casting strands of different widths and thicknesses includes two first plate-shaped side walls arranged opposite each other and defining a mold cavity at two opposite sides, each of the two first side walls having a recess at one side edge, two second side walls each arranged so as to be sunk in one of said recesses at an angle to said first side walls, the second side walls having front surfaces pressable against the first side walls so as to form a peripherally closed mold cavity. The first side walls may be subdivided into several parts assembled in the manner of a circulating continuous chain, each chain being guided over an upper and a lower deflection pulley. In a method for operating a continuous casting mold of the above-defined kind, the adjustment force relative the strand is measured during casting, and a lower deflection pulley is adjusted to the oppositely arranged lower deflection pulley until the two oppositely arranged strand shells contact each other.

23 Claims, 8 Drawing Figures

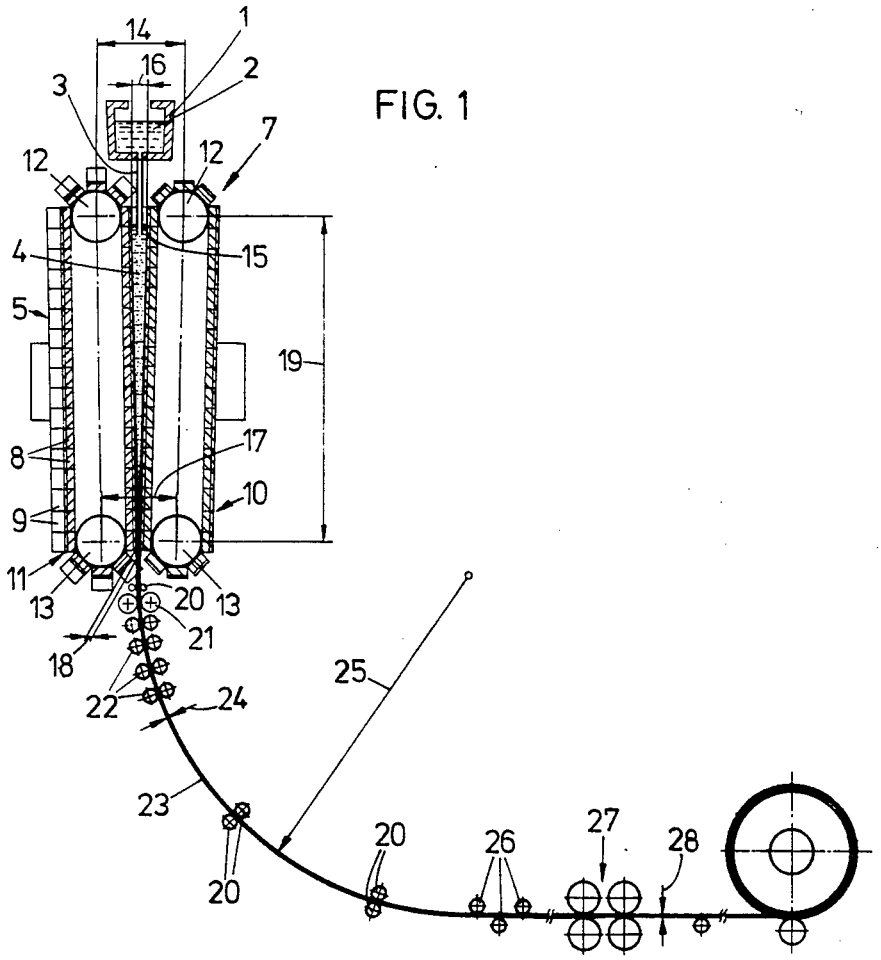
FIG. 1
FIG. 7
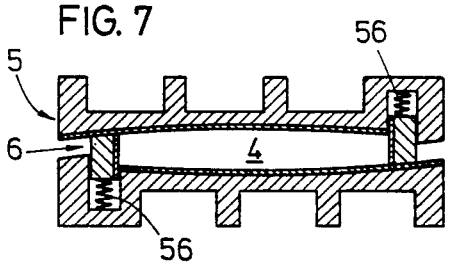
FIG. 8
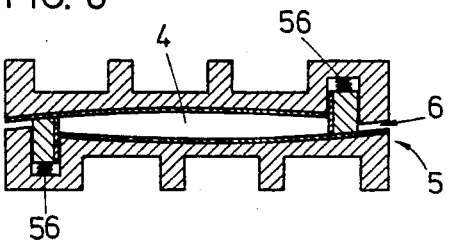

CONTINUOUS CASTING MOLD FOR SELECTIVELY CASTING STRANDS OF DIFFERENT WIDTHS AND THICKNESSES AND A METHOD FOR OPERATING THE CONTINUOUS CASTING MOLD

This invention relates to a continuous casting mold for selectively casting strands of different widths and thicknesses.

With plate molds for casting strands having bloom or slab cross-sections, it is known (U.S. Pat. No. 3,292,216) to form the mold cavity by means of wideside walls between which end walls are inserted. In order to cast strands of various widths with this mold, the end walls are moved between the wideside walls towards each other and away from each other, the taper being adaptable to the strand width.

However, in order to cast strands of different thicknesses, the end walls must be exchanged for end walls having another width, which is cumbersome and has resulted in exchanging the entire mold.

An adjustable plate mold for casting strands of various widths and thicknesses is known from U.S. Pat. No. 3,049,769. The mold cavity of that mold is comprised of four panels, one panel of which always engages at the side surface of the adjacent panel by its front side. Complex clamping means serve to fix the panels relative to each other. Adjusting the mold to strands of various widths and thicknesses is not only very time consuming, but also connected with problems, because a change in the taper of the mold is hardly feasible without extensive modifications.

The invention aims at avoiding these disadvantages and difficulties and has as its object to provide a continuous casting mold for selectively casting strands having different widths and thicknesses, whose cross-sectional adjustment is readily changeable and with which the taper of the walls may be altered within wide limits.

In accordance with the invention, this object is achieved in that two oppositely arranged, plate-shaped first sidewalls delimiting the mold cavity on two opposite sides are each provided with a recess on a side edge, in which a second sidewall arranged at an angle relative to the first sidewalls is each inserted to be sunk therein, the second sidewalls, with their front faces, being pressable against the first sidewalls to form a peripherally closed mold cavity.

A particularly simple mode of construction of the mold according to the invention is characterized in that the first sidewalls are displaceable in the direction towards and away from each other as well as in a direction perpendicular thereto and to the longitudinal axis of the mold cavity.

A particular object of the invention resides in providing a continuous casting mold that is suited for casting steel strands with rough strip cross-sections having a thickness of between 20 and 60 mm. To cast such rough strips it is known to apply the continuous casting and rolling process (British Pat. No. 262,291), wherein, however, the taper of the strand is narrow sides is hardly adjustable and the liquid sump must have a slight length only, because it is not possible to provide supporting means closely below the casting rolls.

This particular object is solved according to the invention in that the first sidewalls are subdivided into several parts transversely to the longitudinal axis of the mold cavity, which parts are assembled in the manner of a circulating continuous chain, and wherein the second sidewalls also are subdivided into parts, one part each of a second sidewall being guided in one part of the first sidewall.

A mold whose sidewalls are designed as continuous chains in the manner of a crawler is known, for instance, from German Pat. No. 688,836. The individual sidewall parts of the mold, with this known mold, are guided on tapering guide rulers arranged between the oppositely arranged sidewalls, whereby the sidewalls being in contact with the strand are approached to each other while the crawler-type chains circulate, until they finally contact each other, thus forming the final mold cross-section proper. This final cross-section, however, is not variable for casting strands of different thicknesses or widths, and there is a taper of the mold cavity just in one direction, i.e., in the direction of the guide ruler, which taper can be varied only by exchanging the guide rulers.

In order to be able to cast a steel strand with rough strip cross-section without faults, i.e., in order to supply the steel melt to the mold cavity by means of a casting tube, which casting tube immerses into the casting level present within the mold, the invention provides that the parts of the first sidewalls are adjusted relative to each other at an angle in the range of between 1° and 10°, the thickness of the uppermost mold cross-section being in a range of between 150 and 200 mm and the thickness of the lowermost closed mold cross-section being in a range of between 20 and 60 mm.

In order to achieve a good tightness between the first and second sidewalls, the second sidewalls or parts of the sidewalls suitably are pressable at the first sidewalls or their parts by means of springs, wherein a good guidance of the second sidewalls or their parts is obtainable in particular if the first sidewalls or their parts are provided with a bracket externally supporting the second sidewalls or their parts and projecting beyond the contact surfaces of the first sidewalls being in contact with the strand.

In order to achieve a sufficient tightness between the first sidewalls and the second sidewalls inserted therein, the second sidewalls or their parts suitably are pressed in the direction towards the oppositely arranged second sidewalls or their parts, by means of springs supported on the first sidewalls or their parts.

The taper of the mold cavity in the width direction may be adjusted in a particularly simple manner, if the first sidewalls are inclinable about a pivot axis directed perpendicular to the plane of symmetry lying between the first sidewalls.

The taper in the thickness direction advantageously is adjustable by guiding the circulating chains formed by the parts of the sidewalls about an upper deflection pulley journaled so as to be non-adjustable with respect to a stand and a lower deflection pulley movable with respect to the stand in the direction to the plane of symmetry and opposite thereto.

In order to ensure a sufficient pressing force between the parts of the first sidewalls and the strand, the lower deflection pulleys suitably are supported relative to the stand by means of a pressure medium cylinder, a measuring device being provided for measuring the supporting force.

In order to eliminate a possibly present play between the parts of the first and second sidewalls in the longitudinal direction of the mold cavity, the upper deflection pulley advantageously can be driven, while the lower deflection pulley can be braked.

According to a preferred embodiment, each chain run moving oppositely to the strand moving direction is guided through a cooling zone and, if desired, through a cleaning and lubricating zone, thus safeguarding the tightness of the mold and its durability to a particular extent.

Advantageously, cooling means applying coolant onto the chain, as well as support rollers are provided on the rear side of the run of each chain moving in the strand moving direction.

In order to achieve as high a stability of the sidewalls as possible, the lower deflection pulley is hinged to the upper deflection pulley by means of an articulation rod.

Preferably, the second sidewalls or their parts, on the surfaces contacting the first sidewalls or their parts, and/or the recesses on the surfaces contacting the second sidewalls or their parts are provided with a wear-resistant layer or with wear ledges.

The invention, furthermore, relates to a method for operating the continuous casting mold of the invention, which method is characterized in that, during casting, the adjustment force to the stand is measured and a lower deflection pulley is adjusted with respect to the opposite lower deflection pulley until the two opposite strand shells contact each other so that the strand leaves the mold completely solidified. This measure makes it all the more possible to cast with high casting speeds so that the casting output does not lag behind the present casting outputs of slab casters, but possibly even exceeds the same.

The invention will now be explained in more detail by way of an embodiment and with reference to the accompanying drawings, wherein:

FIG. 1 schematically illustrates a continuous casting plant for casting a strand with rough strip cross-section;

FIGS. 7 and 8 show a modified embodiment in a schematic illustration analogous to FIG. 6.

Figure 2:
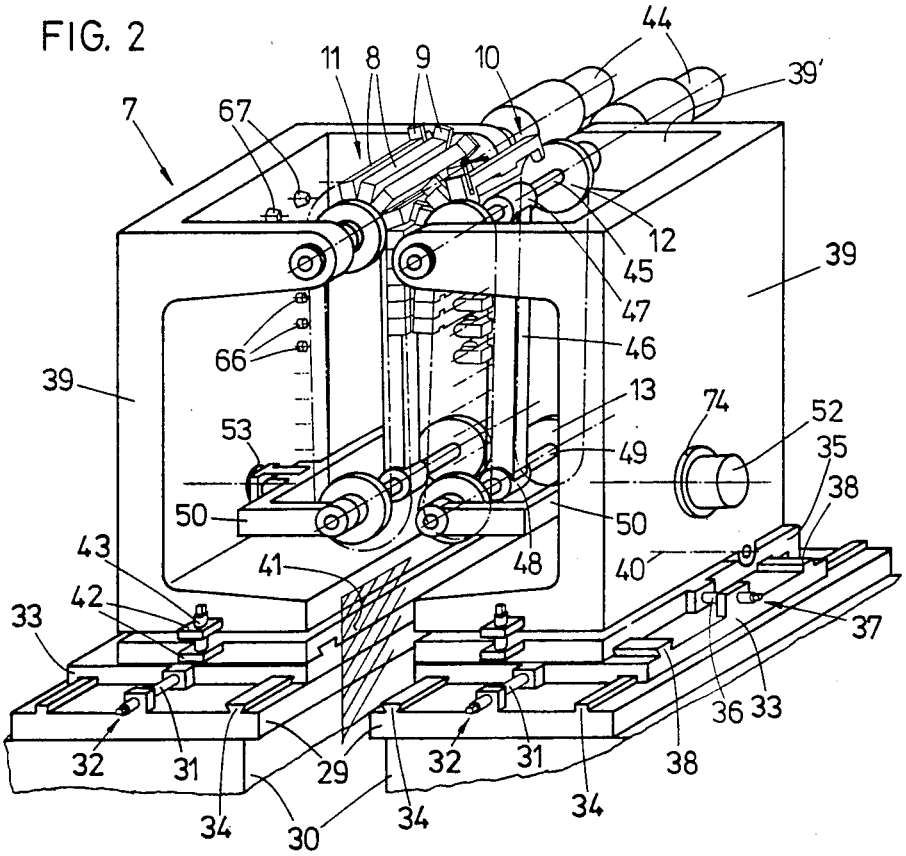
FIG. 2 is an isometric view of the mold according to the invention used therein.
Figure 5:
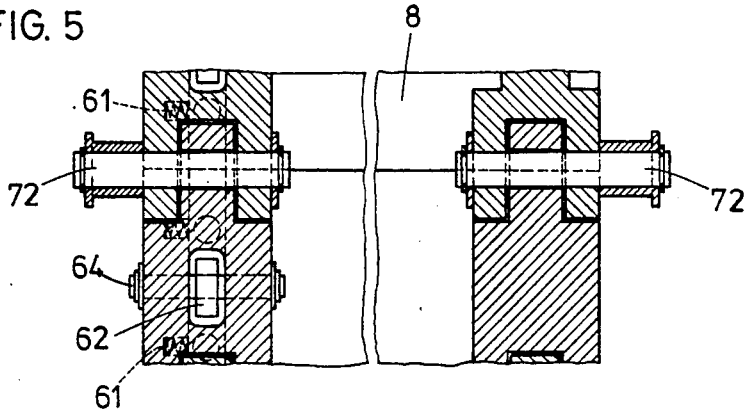
FIGS. 5 and 6 are sections along lines V—V and VI—VI of FIG. 3.
Figure 3:
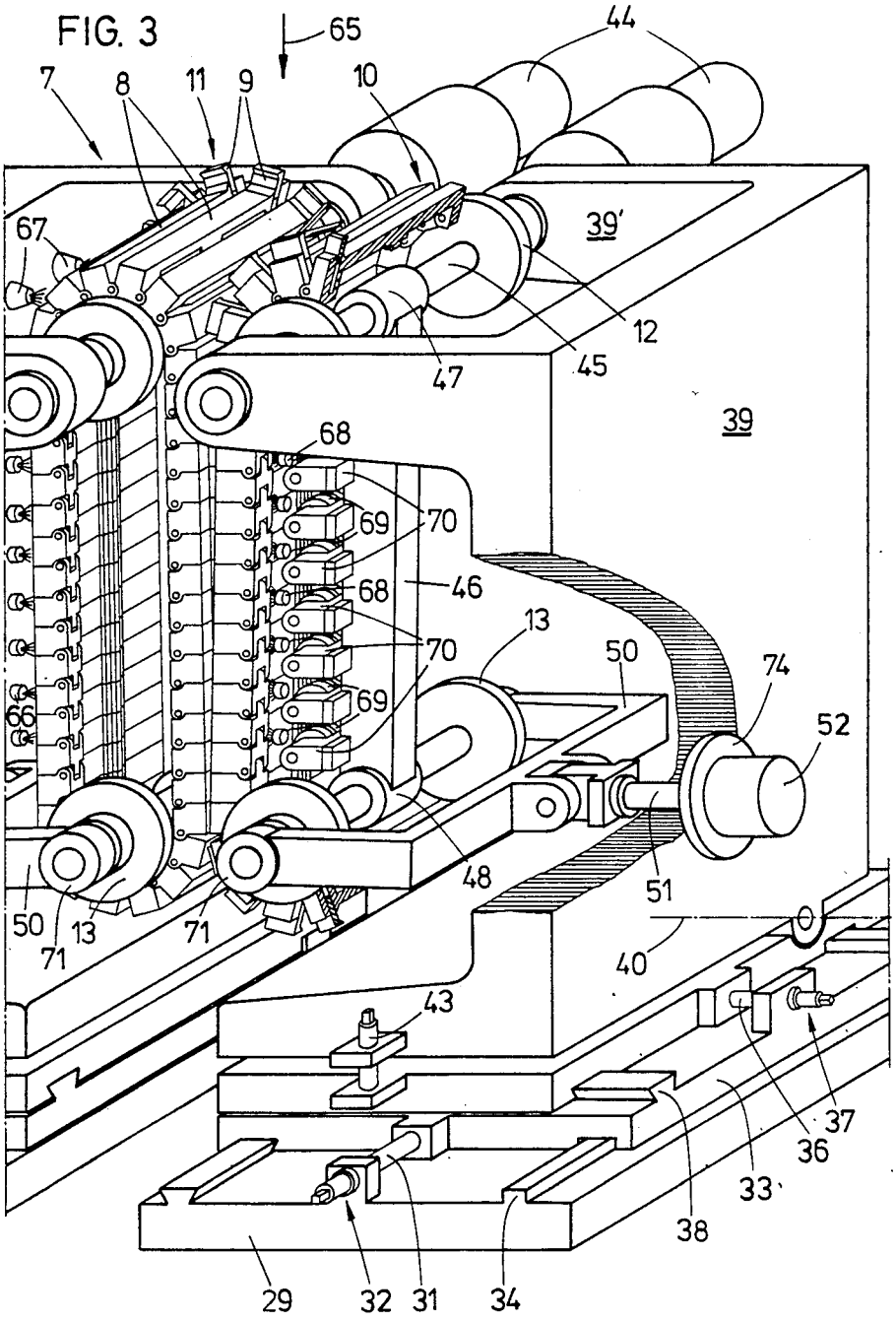
FIG. 3 is a partially sectioned detailed illustration of FIG. 2 on an enlarged scale.
Figure 4:
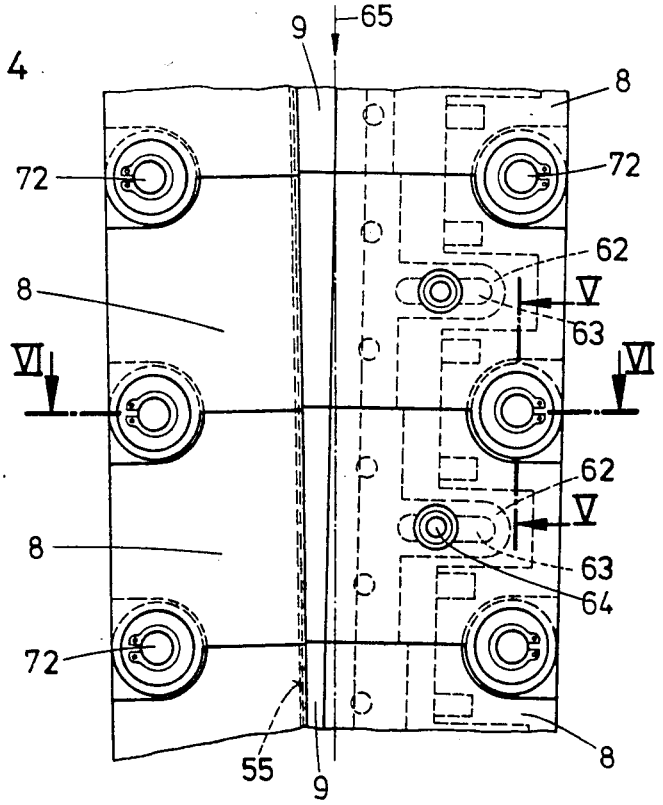
FIG. 4 illustrates a piece of a mold in side view.

From a tundish 1, steel melt 2 gets into the mold cavity 4 of a mold 7 comprised of subdivided broad sidewalls 5 and subdivided narrow sidewalls 6 after having passed a conventional casting tube 3 of common dimensions, the parts 8, 9 of the broad 5 and narrow 6 sidewalls being assembled in the manner of a circulating continuous chain. The chains 10, 11 constituting the broad 5 and narrow 6 sidewalls are each guided over an upper and a lower deflection pulley 12, 13, the distance 14 of the oppositely arranged deflection pulleys 12 being dimensioned such that the casting tube 3 immerses into the molten steel melt to below the casting level 15. The thickness 16 of the mold cavity 4 at this site is about 150 to 200 mm.

The lower deflection pulleys 13 are arranged at a slight distance 17, whereby the mold cavity 4 on the lower end of the mold has a thickness 18 of between 20 and 60 mm.

The length 19 of the mold cavity, i.e., the mold cavity 4 between the axes of the upper and lower deflection pulleys 12, 13 is 1.5 to 3 m.

On the mold run-out end, support rollers 20, driving rollers 21 and bending rollers 22 bending the strand into a circular path are provided. Since the strand 23 has only a slight thickness 24 of between 20 and 60 mm, the circular path may have an accordingly small radius 25, i.e., of about 1.5 m.

After deflection of the strand 23 into the horizontal, it is straightened by means of bending rollers 26 and, suitably without previous subdivision, is rolled to a thickness 28 of between 10 and 30 mm by means of a rolling mill 27 arranged on line. Between the rolling mill 27 and the circular-arc-shaped strand guide, a looping may be provided on account of the relatively slight thickness 24 of the strand, allowing for a co-ordinated control of rolling mill 27 and continuous casting plant.

Alternatively, it is possible to wind up the cast strand to form a coil already in the region of the bending rollers 26 or on another site.

After the rolled strip has emerged from the rolling mill 27, the former is either wound up in the hot state, as illustrated in FIG. 1, or it is further directly rolled, e.g. is a broad strip mill, an economical use of the broad strip mill requiring a plurality of continuous casting plants of the type disclosed.

The particular construction of the mold 7 can be seen from FIGS. 2 to 6. The mold 7 has two base plates 29 rigidly fastened to the substructure 30. By an adjustment means 32 having a threaded spindle 31, on each these base plates a guiding plate 33 is provided parallel to the base plate and displaceable along guiding rails 34 lying parallel to the width of the mold cavity 4. On each of these guiding plates 33, a carrying plate 35 arranged parallel to the base plate 29 is provided, which carrying plate is also displaceable by an adjustment means 37 provided with a threaded spindle 36, i.e., in the direction towards the opposite carrying plate 35 and opposite thereto. For a secure guiding of the carrying plate 35, guiding rails 38 arranged on the guiding plate 33 perpendicular to the broad side of the mold 7 are provided.

On each carrying plate 35, a stand 39, C-shaped when viewed from the side, is pivotably mounted, the pivot axis 40 being directed perpendicular to the plane of symmetry 41 of the mold 7 lying between the broad sidewalls 5. The pivoting movement can be effected by means of a threaded spindle 43 arranged on brackets 42 of the carrying plate 35 and of the stand 39.

On each approximately horizontal upper extension arm 39' of each stand 39, the upper deflection pulley 12 is each rotatably mounted and drivable by means of a motor 44. On the rotating axle 45 of the deflection pulley 12, a connecting-rod-type articulation rod 46 is hinged with an upper bearing eye 47, and at its lower bearing eye 48 a rotating axle 49 of the lower deflection pulley 13 is mounted. Each lower deflection pulley 13 is furthermore rotatably journaled in a C-shaped hoop 50 bracket-like embracing the lower deflection pulley 13. The middle part of the C-shaped hoop 50 is mounted to a piston rod 51 of a pressure medium cylinder 52, which piston rod penetrates a recess 53 of the stand 39 so that the pressure medium cylinder 52 itself is mounted to the outer side of the stand 39.

Each part 8 of a first sidewall, i.e., of the broad sidewall 5, at one of its ends has an edge side recess 54, into which a part 9 each of the second sidewall, i.e., of the narrow sidewall 6, is inserted so as to be sunk therein, the second sidewall 6 being at a right angle to the first sidewall 5, and the parts 9 of the second sidewalls 6 with their front faces 55 being pressable against the parts 8 of the oppositely arranged first sidewalls 5 by means of springs 56 provided in the recesses 54.

Figure 6:
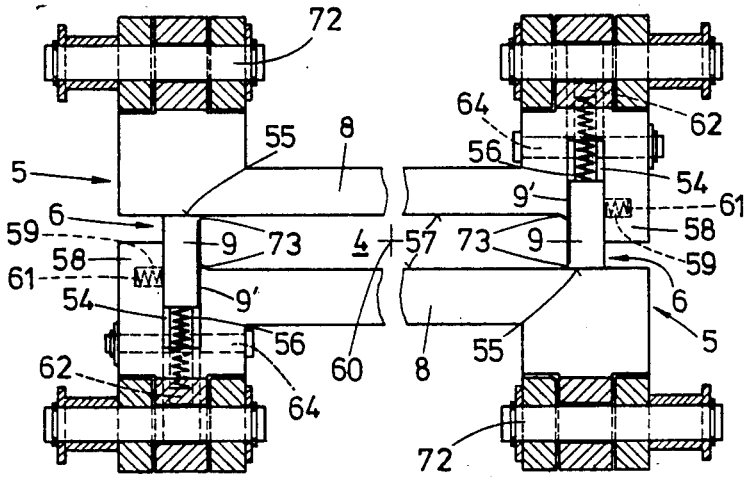

Each of the chain members thus forms an L-shaped part seen from above, always two of them forming a peripherally closed mold cavity 4 when assembled, as can be seen from FIG. 6.

For a good support of the parts 9 of the narrow sidewalls 6, the parts 8 of the broad sidewalls 5 are each provided with a bracket 58 projecting beyond the contacting surfaces 57 of the broad sidewalls 5 that are in contact with the strand. In this bracket a recess 59 is inwrougth, in which a spring 61 is inserted, which spring presses the parts 9 of the narrow sidewalls 6 in the direction towards the longitudinal axis 60 of the mold cavity 4. The spring forces of these springs 61 are smaller than the forces of the springs 56 that press the parts 9 out of the recess 54 in the direction towards the oppositely arranged broad sidewall 5. The surfaces of the parts 9 that are in sliding contact with the parts 8, are protected against a high wear by application of a wear-resistant layer 9' (chromium plating etc.) or by application of wear ledges.

For securing the part 9 of the narrow sidewalls 6 against falling out of the recesses 54, the parts 9 at their ends opposite the front faces 55 each are provided with a bracket 62 directed approximately perpendicular to the broad sidewalls 8, the bracket 62 having a long hole whose longitudinal axis also is approximately perpendicular to the broad sidewalls 8. This long hole 63 is penetrated with play by a pin 64 that is fixed to the parts 8 of the broad sidewalls.

As can be seen from FIG. 2, each run of the chains 10, 11, moving contrary to the moving direction 65 of the strand, is guided through a cooling zone 66, and, if desired, through a cleaning and lubricating zone 67. On the rear side of the run of each chain 10, 11 moving in the strand moving direction 65, cooling means 68, such as e.g., spraying nozzles, applying coolant onto the chain, as well as supporting rollers 69 are provided, which are fastened by means of brackets 70 on the articulation rod 46. Each lower deflection pulley is mounted in the C-shaped hoop 50 by means of a bearing 71 braking the rotating movement of the deflection pulley 13, whereby a possibly present bearing play of the articulation pins connecting the parts 8 of the broad sidewalls 5 can be eliminated, and the parts 8 of each chain following upon each other lie close to each other.

Since, due to the conical course of the mold cross-section over the length 19 of the mold 7, the narrow sides of the cast strand must continuously be reduced, the edges of the mold cavity are made slanting, i.e., by providing bevellings 73 both on the parts 9 of the narrow sidewalls 6 and on the parts 8 of the broad sidewalls 5. These bevellings 73 have the effect that the material of the narrow side of the strand can flow more easily to the broad side thereof.

The mold 7 disclosed above has substantial advantages when casting steel strands, which advantages partly also are effective when casting strands of conventional slab format, i.e., those having a thickness of from 150 to 300 mm. These advantages mainly reside in the fact that due to the concurrent movement of the broad sidewalls 5 and narrow sidewalls 6, there practically occurs no relative velocity between the strand surface and the broad sidewalls 5 and narrow sidewalls 6, whereby extraction forces to be applied to the strand are avoided.

A further advantage consists in that the mold can be built relatively long, and a relatively high ferrostatic pressure can be achieved within the mold 7. The strong pressing of the strand shell to the mold sidewalls 5, 6 increases the heat delivery at all contacting surfaces between strand and mold, thus ensuring a rapid growth of the shell thickness within the mold. This causes a fine grain formation and prevents the formation of dendrites, having a favorable effect on the steel quality. Simultaneously, it is possible to generally increase the casting speed, due to the avoidance of friction, the rapid growth of the shell thickness and the increased mold length.

The adjustment of the broad sidewalls 5 by means of the pressure medium cylinder 52 is suitably effected by using pressure measuring means 74 or load cells that make it possible to determine whether the broad sidewalls 5 at the lower end of the mold are in contact with the strand surfaces. When casting strands having thicknesses of between 20 and 60 mm, the pressure measuring means 74 make it possible to determine whether or not there is still a liquid core between the two shell walls of the strand. If there is a liquid core, it may be caused to disappear by pressing the shell surfaces towards each other by means of the pressure medium cylinders 52 at the mold end, so that at the end of the mold 7 the strand has solidified throughout. By controlling the speed of the broad and narrow sidewalls 5, 6, a solidification throughout can also be obtained for a certain desired strand thickness. A strand solidified throughout at the end of the mold allows for a particularly simple support of the strand 23 in the supporting and guiding stand following upon the mold 7 and for an immediate coiling up of the strand that may also be called thin slab or rough strip, respectively.

Casting steel strands having rough strip cross-sections, so-called "thin slabs", with the mold disclosed above, furthermore has the advantage that, because of the relatively wide upper cross-section of the mold 7, casting powder may be used in the conventional manner, which casting powder prevents oxidation of the molten steel.

The longitudinally wedge-shaped strand portion that is within the mold 7 causes differing flow speeds of the molten steel within the respective strand cross-sections. The strand shell has the same speed over the entire length of the mold, whereas the strand core moves the slower, the larger respective strand cross-section. This causes an intensive mixing of the molten core, thus avoiding the formation of segregation zones.

The rapid growth of the shell thickness and the long mold 7 allow for a very high casting speed, i.e., even if a complete solidification of the strand is desired at the lower end of the mold, Thus, very thin strands 23 may be cast with casting speeds of from 5 to 10 m/min, so that the casting performance of the above described mold 7 for "thin slabs" is at least as high as the casting performance of conventional slab casting plants. The high casting speed allows for the direct rolling without a preceding division of the strand.

A further advantage of the mold is that the mold may be divided for service in a simple manner by moving apart the guiding plates 33 or the base plates 29.

What I claim is:

1. A continuous casting mold for selectively casting strands of different widths and thicknesses, comprising two first plate-shaped sidewalls having facing surfaces arranged opposite each other and defining a mold cavity at two opposite sides, each of said two first sidewalls having a recess at a single side edge of said first sidewalls' respective facing surface, two second sidewalls each having a rear face and each of said second sidewalls being arranged so as to be sunk in one of said recesses with said second sidewalls' respective rear face bearing in a respective first sidewall said sidewalls, the second sidewalls having front faces pressable against and in facing relationship to the facing surface of said first sidewalls so as to form a peripherally closed mold cavity.

2. A continuous casting mold as set forth in claim 1, wherein said first sidewalls are displaceable towards and away from each other as well as in a direction perpendicular thereto and along the longitudinal axis of the mold cavity.

3. A continuous casting mold as set forth in claim 1, particularly for casting steel strands having rough strip cross-sections with a thickness of between about 20 and 60 mm, wherein said first sidewalls are subdivided transversely to the longitudinal axis of the mold cavity into several parts, said parts being arranged in a circulating continuous chain, and wherein the second sidewalls are subdivided into parts, one part of each second sidewall being guided in a part of its respective first sidewall.

4. A continuous casting mold as set forth in claim 3, wherein the parts of the first sidewalls are adjusted to each other under an angle of between 1° and 10°, the mold having an uppermost cross-section with a thickness of between 150 and 200 mm, and a lowermost closed cross-section with a thickness of between 20 and 60 mm.

5. A continuous casting mold as set forth in claim 3, further comprising springs for pressing said parts of said second sidewalls against said parts of said first sidewalls.

6. A continuous casting mold as set forth in claim 1, further comprising spring means for pressing said second sidewalls against said first sidewalls.

7. A continuous casting mold as set forth in claim 1, further comprising brackets provided on said first sidewalls for externally supporting said second sidewalls, said first sidewalls having contacting surfaces contacting the strand, said brackets projecting to beyond said contacting surfaces of said first sidewalls.

8. A continuous casting mold as set forth in claim 1, comprising further springs supported in said first sidewalls and pressing each of said second sidewalls in a direction towards the oppositely arranged second sidewall.

9. A continuous casting mold as set forth in claim 1, wherein said first sidewalls are inclinable about a pivot axis oriented perpendicular to the plane of symmetry lying between said first sidewalls.

10. A continuous casting mold as set forth in claim 1, further comprising wear-resistant means, provided on said second sidewalls, at the surfaces of the second sidewalls contacting said first sidewalls.

11. A continuous casting mold as set forth in claim 10, wherein said wear-resistant means are one of a wear resistant layer and a wear ledge.

12. A continuous casting mold as set forth in claim 1, further comprising wear-resistant means provided on said recesses at the surfaces of said recesses contacting said second sidewalls.

13. A continuous casting mold as set forth in claim 1, further comprising wear-resistant means, provided on said second sidewalls, at the surfaces of the second sidewalls contacting said first sidewalls, and wear-resistant means provided on said recesses at the surfaces of said recesses contacting said second sidewalls.

14. A continuous casting mold particularly for casting steel strands having rough strip cross-sections, different widths and a thickness of between about 20 and 60 mm comprising:

(a) a plurality of pairs of first plate-shaped sidewalls arranged opposite each other and defining a mold cavity at two opposite sides, each of said pair of first sidewalls having a recess at one side edge;

(b) a plurality of pairs of second sidewalls each arranged so as to be sunk in a respective one of said recesses at an angle to said first sidewalls, the second sidewalls having front faces pressable against the first sidewalls so as to form a peripherally closed mold cavity, said first sidewalls being subdivided transversely to the longitudinal axis of the mold cavity into several parts, said parts being arranged in a circulating continuous chain, and wherein the second sidewalls are subdivided into parts, one part of each second sidewall being guided in a part of its respective first sidewall; and (c) springs supported in said parts of said first sidewalls and pressing each of said parts of said second sidewalls in a direction towards the oppositely arranged parts of said second sidewalls.

15. A continuous casting mold particularly for casting steel strands having rough strip cross-sections, different widths and a thickness of between about 20 and 60 mm comprising:

(a) a plurality of pairs of first plate-shaped sidewalls arranged opposite each other and defining a mold cavity at two opposite sides, each of said pair of first sidewalls having a recess at one side edge;

(b) a plurality of pairs of second sidewalls each arranged so as to be sunk in a respective one of said recesses at an angle to said first sidewalls, the second sidewalls having front faces pressable against the first sidewalls so as to form a peripherally closed mold cavity, said first sidewalls being subdivided transversely to the longitudinal axis of the mold cavity into several parts, said parts being arranged in a circulating continuous chain, and wherein the second sidewalls are subdivided into parts, one part of each second sidewall being guided in a part of its respective first sidewall;

(c) a stand, (d) an upper deflection pulley undisplaceably mounted relative to said stand, and (e) a lower deflection pulley movable relative to the stand in the direction towards the plane of symmetry and away therefrom said circulating continuous chains formed by said parts of said sidewalls being guided over said upper and said lower deflection pulleys.

16. A continuous casting mold as set forth in claim 15, further comprising a pressure medium cylinder for supporting said lower deflection pulleys relative to said stand, and measuring means for measuring the supporting force.

17. A continuous casting mold as set forth in claim 15, further comprising means for driving said upper deflection pulley and means for braking said lower deflection pulley.

18. A continuous casting mold as set forth in claim 15, further comprising a cooling zone, each of said continuous chains having runs guided through said cooling zone when said runs move contrary to the strand moving direction.

19. A continuous casting mold as set forth in claim 18, further comprising a cleaning and lubricating zone, each of said runs of said continuous chains being guided through said cleaning and lubricating zone when said runs move contrary to the strand moving direction.

20. A continuous casting mold as set forth in claim 15, wherein each of said continuous chains has runs, and further comprising cooling means provided on the rear side of each of said runs of said continuous chain moving in the strand moving direction for applying coolant onto said continuous chain, and supporting rollers also provided on the rear side of each of said runs of said continuous chain.

21. A continuous casting mold as set forth in claim 15, further comprising an articulation rod for hinging said lower deflection pulley to said upper deflection pulley.

22. In a method for operating a continuous casting mold for selectively casting strands of different widths and thicknesses, such as strands having rough strip cross-sections with a thickness of between about 20 and 60 mm, the continuous casting mold including two first plate-shaped sidewalls having facing surfaces arranged opposite each other and defining a mold cavity at two opposite sides, each of said two first sidewalls having a recess at a single side edge of said first sidewalls' respective facing surface, two second sidewalls each having a rear face and each arranged so as to be sunk in one of said recesses with said second sidewalls' respective rear face bearing against a respective recess in a respective first sidewall at an angle to said respective first sidewall, the second side walls having front faces pressable against the facing surfaces of said first sidewalls so as to form a peripherally closed mold cavity, each of said first sidewalls being subdivided transversely to the longitudinal axis of the mold cavity into several parts, said parts being assembled and circulated as a continuous chain, and the second sidewalls also being subdivided into parts, one part of a second sidewall being each guided in a part of the first sidewall, a stand, an upper deflection pulley, and a lower deflection pulley beng provided, said upper deflection pulley being undisplaceably mounted relative to said stand, and said lower deflection pulley being movable relative to the stand, said continuous chains formed by the parts of said sidewalls being guided over said upper and said lower deflection pulleys, the improvement comprising measuring the adjustment force relative to the strand during casting, and adjusting one of said lower deflection pulleys relative to the oppositely arranged lower deflection pulley until the two oppositely arranged strand shells contact each other.

23. A continuous casting mold particularly for casting steel strands having rough strip cross-sections, different widths and thicknesses comprising:

(a) a plurality of pairs of first plate-shaped sidewalls having facing surfaces arranged opposite each other and defining a mold cavity at two opposite sides, each of said pair of first sidewalls having a recess at a single side edge of said first sidewalls respective facing surface; and (b) a plurality of pairs of second sidewalls each having a rear surface and each of said second sidewalls being arranged so as to be sunk in a respective one of said recesses with a respective rear face bearing against a respective recess at an angle to a respective first sidewall, the second sidewalls having front faces pressable against and in facing relationship to the facing surfaces of said first sidewalls so as to form a peripherally closed mold cavity, said first sidewalls being subdivided transversely to the longitudinal axis of the mold cavity into several parts, and (c) means for continuously advancing said sidewalls, said parts being arranged in a circulating continuous chain, and wherein the second sidewalls are subdivided into parts, one part of each second sidewall being guided in a part of its respective first sidewall.

* * * * *